US005406294A

United States Patent [19]

Silvey et al.

[11] Patent Number: 5,406,294

[45] Date of Patent: Apr. 11, 1995

[54] FLOATING ANTENNA SYSTEM

[75] Inventors: Trevor Silvey, Dorset; Roy F. J. Orwell, Somerset, both of Great Britain; David A. Mortimer, North Attleboro, Mass.

[73] Assignee: Spears Associates, Inc., Norwood, Mass.

[21] Appl. No.: 60,869

[22] Filed: May 13, 1993

[51] Int. Cl.[6] ..... H01Q 1/34

[52] U.S. Cl. ..... 343/709; 343/872; 441/1; 441/30

[58] Field of Search ..... 343/709, 700 MS; 441/30, 21, 28, 7, 1, 6, 11, 13, 16; H01Q 1/34

[56] References Cited

U.S. PATENT DOCUMENTS

| | | | |
|---|---|---|---|
| 2,907,875 | 10/1959 | Seyfang | 250/17 |
| 3,328,750 | 6/1967 | Gimber et al. | 340/2 |
| 3,992,737 | 11/1976 | Duel et al. | 9/8 R |
| 3,999,183 | 12/1976 | Brett | 343/709 |
| 4,475,109 | 10/1984 | Dumas et al. | 343/709 |
| 4,579,536 | 4/1986 | Cameron | 441/16 |
| 4,675,686 | 6/1987 | Robinson et al. | 343/709 |
| 4,962,488 | 10/1990 | Dell-Imagine et al. | 343/709 |
| 5,020,032 | 5/1991 | Dale et al. | 367/4 |
| 5,060,206 | 10/1991 | DeMetz, Sr. | 367/136 |
| 5,073,136 | 12/1991 | DeWitt et al. | 441/7 |
| 5,132,696 | 7/1992 | Cobb | 343/709 |

*Primary Examiner*—Donald Hajec
*Assistant Examiner*—Hoanganh Le
*Attorney, Agent, or Firm*—Fish & Richardson

[57] ABSTRACT

A floating antenna system which can be deployed and retrieved by an underwater diver is equipped with a pressure proof radome atop an elongated support stalk carrying a lobed, inverted pyramidoidal flotation collar below the radome which can be folded and wrapped transversely around the support stalk like an umbrella when deflated. The air supply for inflation is carried in a pressurized canister inside the support stalk. The collar is inflated via an inflation line from the canister controlled be a manually operated pushbutton valve. The antenna inside the radome is connected to a long tether cable which can be connected to a separate receiver or transmitter below the surface. The tether cable can be manipulated to control deployment and retrieval of the floating antenna.

20 Claims, 9 Drawing Sheets

FLOATING ANTENNA SYSTEM

BACKGROUND OF THE INVENTION

The invention relates to floating antennas.

There are a variety of situations in which waterborne antennas are required. They are used, for example, to broadcast signals from locator beacons deployed from sinking ships or downed aircraft. In other applications, they are used to transmit signals detected by sensing devices—such as sonar detectors—which are suspended below the surface of the water. In many of the current applications for floating antennas, the antenna is designed to remain at the surface; in some applications, such as covert operations, it is designed to be scuttled when it is no longer needed.

In underwater operations conducted by a diver, the diver often needs to transmit or receive information while at different locations under water. It is undesirable for the diver to pull a floating antenna along with him as he moves from location to location, as the tether line creates drag and is susceptible to entanglement. Surfacing to transmit or receive is also undesirable, as it may necessitate decompression stops to avoid decompression sickness (the bends), and it may destroy the secrecy necessary for covert operations.

SUMMARY OF THE INVENTION

The invention provides an antenna which is released by a diver under water, floated to the surface for signal receiving or broadcasting purposes by an inflatable flotation collar, and retrieved for subsequent deployment. The diver deployed, multiply-deployable/multiply-retrievable floating antenna system features a central support stalk, an environmentally sealed, pressure proof radome housing an antenna atop the support stalk, and an inflatable flotation collar surrounding the support stalk to keep the radome above the surface of the water. The system preferably includes a self-contained source of gas and pneumatic system to inflate the flotation collar, and a tether cable which conducts signals to or from the antenna element.

In preferred embodiments, the support stalk is a hollow, free-flooding plastic tube housing a high pressure container of gas. The pressurized container is connected to a valve manifold having a diver operable inflation control, and a gas line leads from the valve manifold to the flotation collar. This configuration allows a diver to release a controlled amount of gas into the flotation collar, and to do so repeatedly in multiple deployments.

The radome is an environmentally sealed chamber consisting of a radome canopy and a radome base to which the canopy is sealed. The radome canopy and radome base are electromagnetically transparent to the antenna element, which allows for signal reception and/or broadcasting. The embodiment of a floating antenna system which is disclosed uses an antenna designed to receive signals from Global Positioning System satellites.

The flotation collar surrounding the support stalk is in the shape of an inverted pyramidoid. The downward taper enhances the vertical stability and prevents inversion of the floating antenna system, keeping the radome above water and oriented substantially vertically even in rough seas. The flotation collar is made from diamond shaped panels of flexible, waterproof, and airtight fabric such as rubberized canvas or high denier nylon. It folds and wraps about the support stalk, and is secured with a hook and loop fastener, when it is deflated.

The signal conducting tether cable transmits signals received at the surface to a submerged signal processing unit which is responsive to the received signals; or, the tether cable transmits signals from a submerged signal generating unit which generates signals to be broadcast from the antenna element.

DESCRIPTION OF THE PREFERRED EMBODIMENTS

Figure 1:
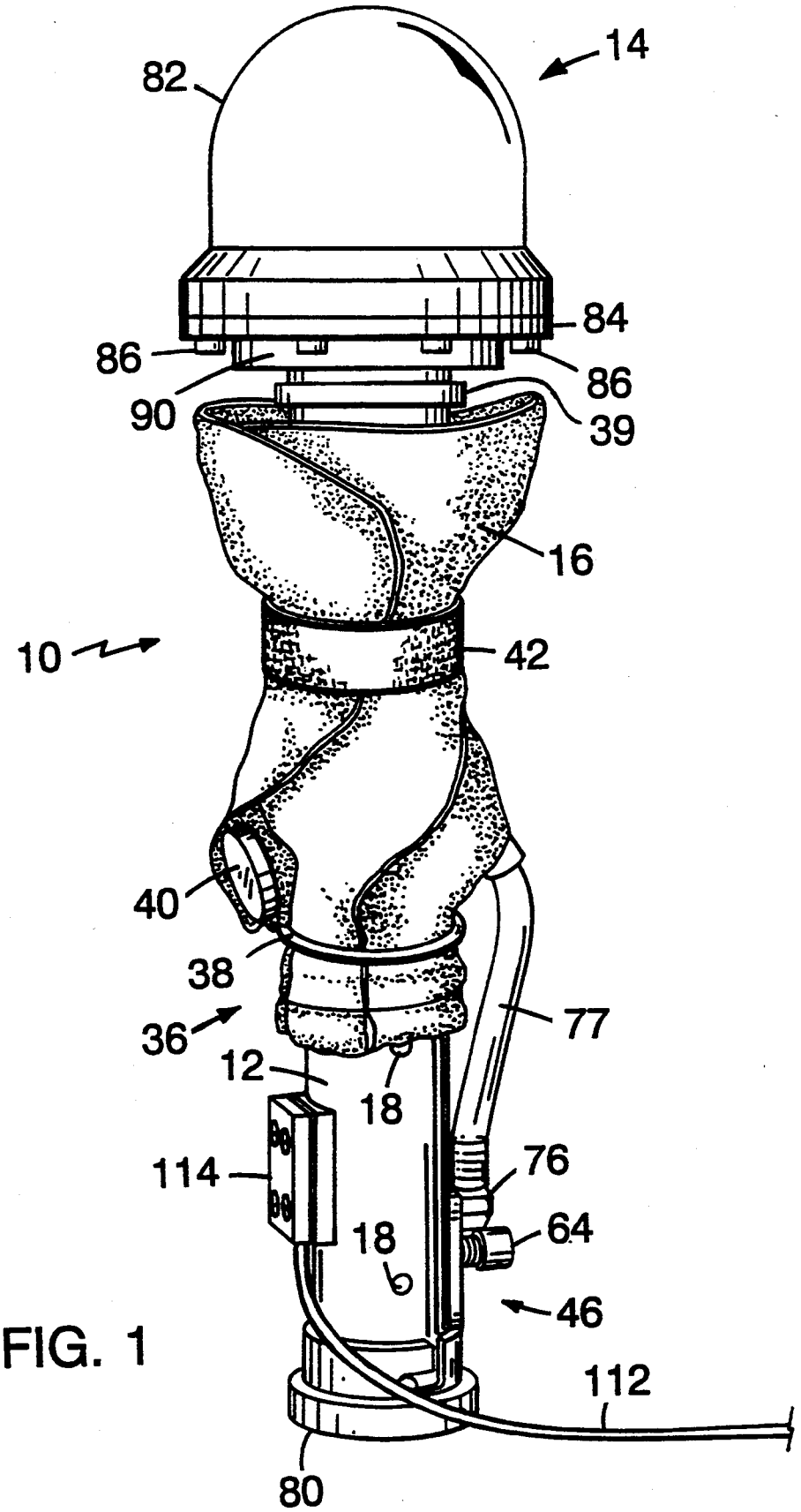
FIGS. 1 and 2 are perspective views of a preferred embodiment of the floating antenna system according to the invention with flotation collar deflated and inflated, respectively.
Figure 2:
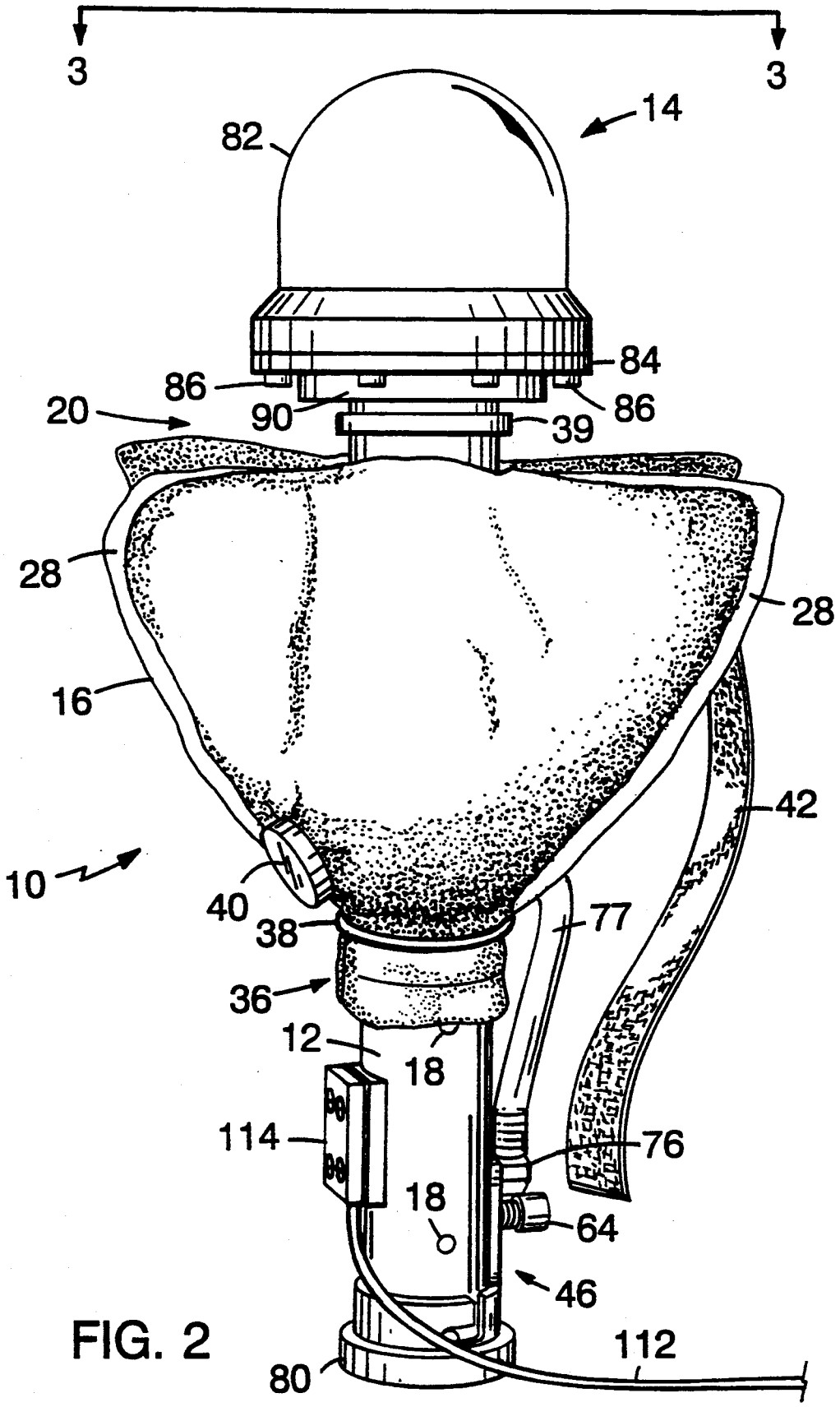

Referring to FIGS. 1 and 2, the floating antenna system 10 is essentially made up of a cylindrical support stalk 12 to which is affixed a pressure proof radome 14 and an inflatable flotation collar 16. Support stalk 12 provides the "backbone" of the system. In the preferred embodiment, support stalk 12 is a hollow cylinder made from a light-weight plastic, preferably ABS, which is resistant to salt water.

Because the floating antenna system 10 is designed to be carried and deployed by a diver, it should be slightly negatively buoyant when the flotation collar is deflated so as to "stay put." Fill/drain holes 18 along the length of support stalk 12 allow the support stalk to fill with water to prevent air trapped within the support stalk from increasing the buoyancy of the system 10.

Figure 3:
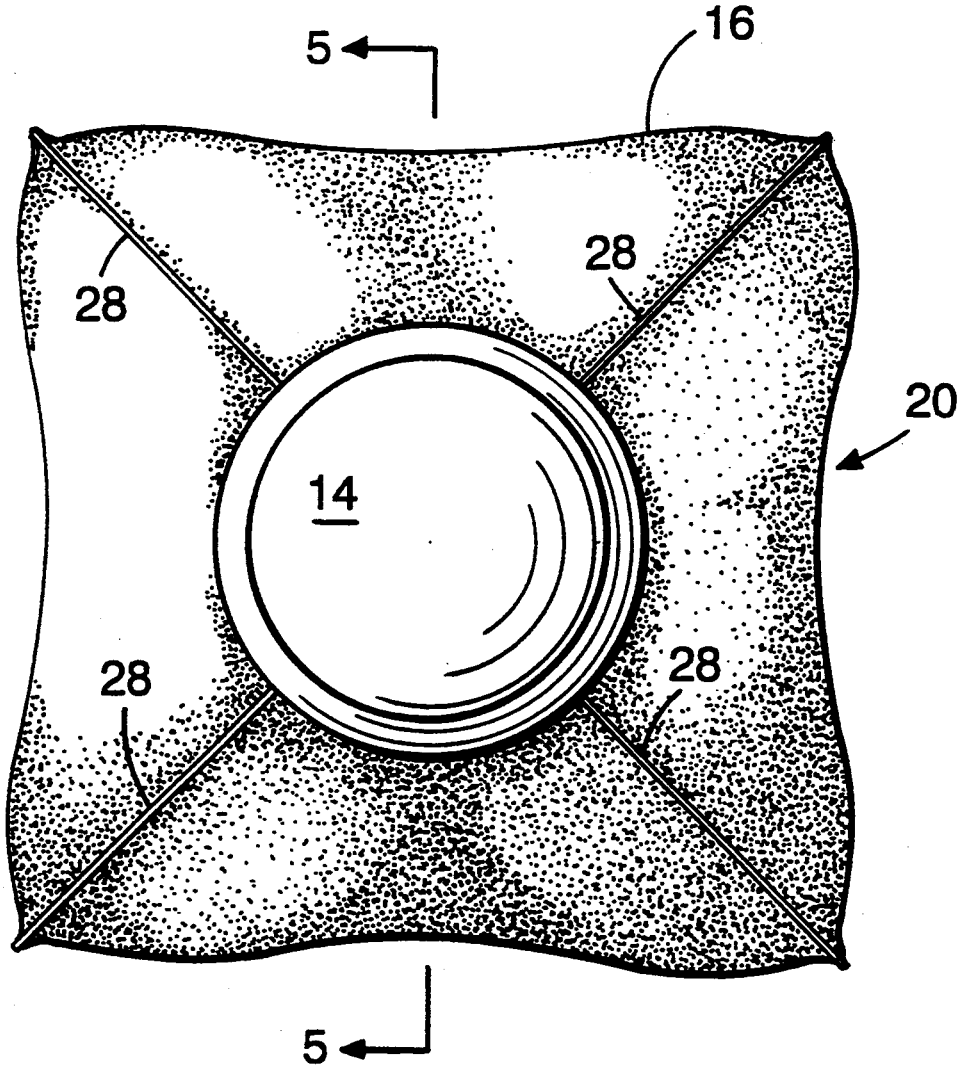
FIG. 3 is a plan view of the floating antenna system of FIG. 2, taken along lines 3—3 in FIG. 2, showing the generally squarish, lobed nature of the flotation collar.

Flotation collar 16 surrounds support stalk 12, and may be likened to a balloon with an internal passageway through it. When inflated, it is in the shape of an inverted pyramidoid, with roughly square base 20 facing upward (FIG. 3).

Figure 4:
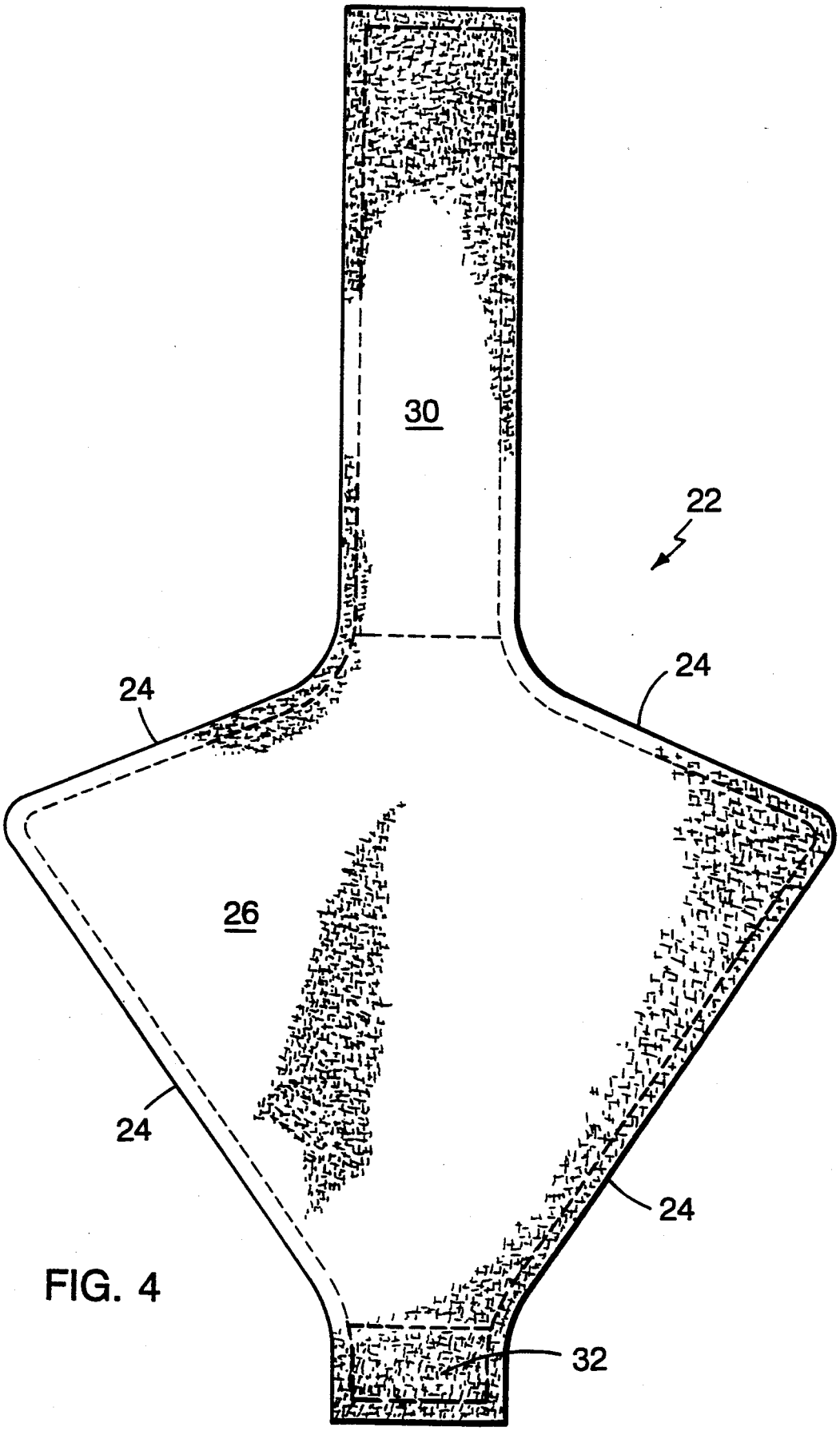
FIG. 4 is a pattern for a panel used to construct the flotation collar of the floating antenna system according to the invention.
Figure 5:
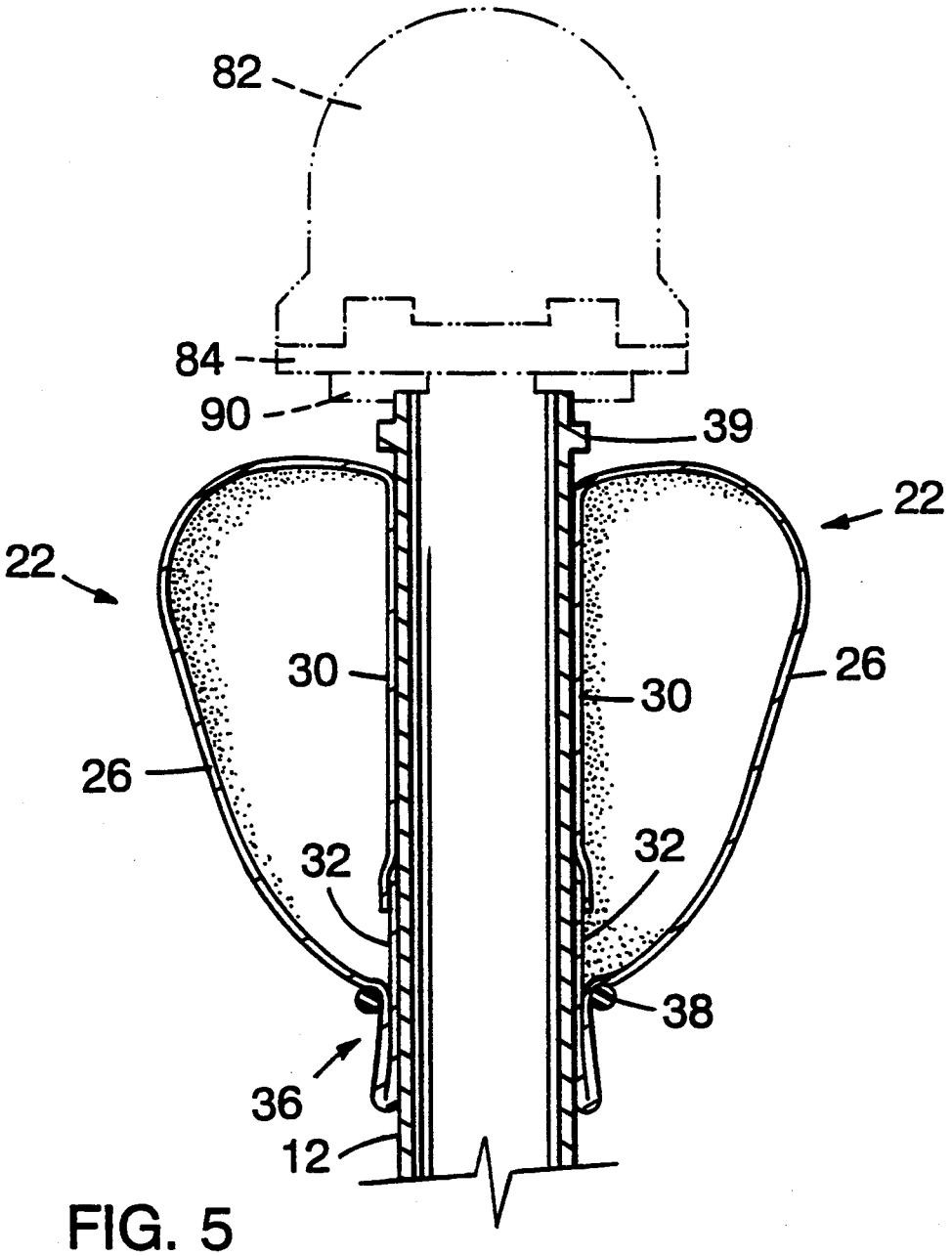
FIG. 5 is a cross sectional view, taken along line 5—5 in FIG. 3, of the flotation collar and part of the support stalk of a preferred embodiment of a floating antenna system according to the invention.

Flotation collar 16 is constructed of an assembly of edgewise connected, diamond-shaped panels 22 of flexible, waterproof, and airtight fabric such as rubberized canvas or high denier nylon (FIG. 4). Edges 24 of mid region 26 of the panels are fastened together in back-to-back fashion to form flat seams 28 (FIG. 2). Edges 24 may be fastened by thermal welding, contact cement, or other means which provide an airtight, watertight seal. As shown in FIG. 5, end tabs 30, 32 are wrapped around and similarly fastened to each other and the end tabs of adjacent panels 22 to form the passageway through which support stalk 12 passes. This construction yields a four-lobed, squarish pyramidoid, with vertex 36 pointing downward.

Tight-fitting O-ring 38 around vertex 36 fixes flotation collar 16 axially along support stalk 12. In addition, ridge 39 (FIGS. 1, 2, and 5) prevents base 20 of the flotation collar from "rising" too high on support stalk 12, thereby ensuring proper hydrodynamic shape of flotation collar 16.

The inverted pyramidoidal shape enhances the stability of floating antenna system 10. For stability, it is necessary to have the center of buoyancy higher than the center of mass, such that deviation of the system from vertical creates a righting moment. A doughnut shaped flotation collar certainly has this characteristic. Because of its flattish profile, however, the center of buoyancy of a doughnut shaped collar is only slightly above its center of mass. Thus, the righting moment created as a doughnut shaped collar is tipped, such as by waves, is minimal.

The downward taper of flotation collar 16, on the other hand, allows it to "pierce" the water and sit relatively lower in the water column. It has greater separation between its centers of mass and buoyancy, yielding a higher righting moment when tipped, and hence better stability than a doughnut shaped collar. Because the cross section below water is narrower, floating antenna system 10 is allowed to "swing" somewhat freely, maintaining a vertical position even as waves move past. The low-sitting profile also reduces observability of the system, a feature which is desireable for covert operations.

Flotation collar 16 must be inflatable to a volume which creates enough positive buoyancy to keep radome 14 above the surface of the water. To prevent overfilling and rupture of inflation collar 16, overpressure dump valve 40 is provided in one of panels 22. Dump valve 40 should vent gas from within inflation collar 16 when pressure inside flotation collar 16 exceeds ambient by 2 psi or more.

Constructing flotation collar 16 out of flexible panels allows it to be folded and wrapped around support stalk 12 like an umbrella when deflated. Hook and loop fastener strap 42 secures flotation collar 16 about support stalk 12.

Figure 6:
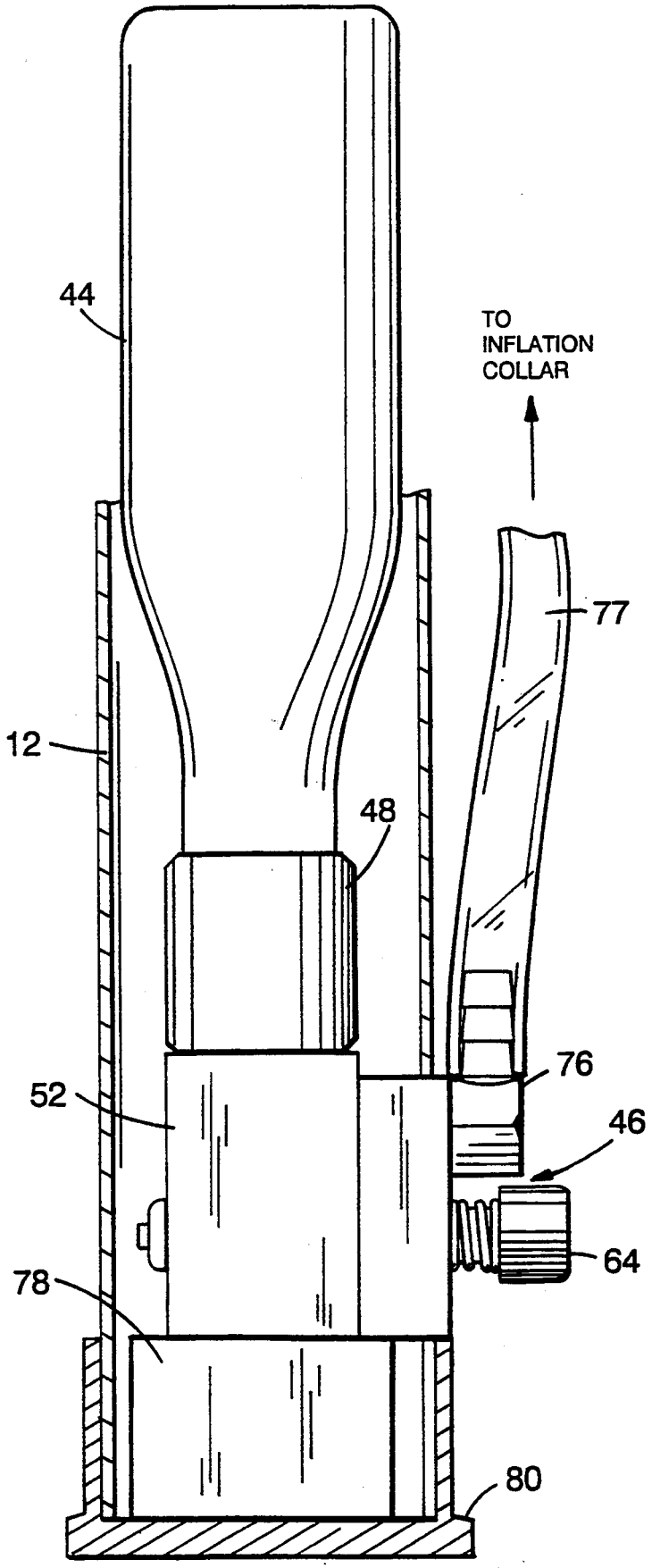
FIG. 6 is a partial elevational view, partially in section, of the lower portion of the support stalk of the floating antenna system of FIG. 1 showing the source of gas and pneumatic system used to inflate the flotation collar.
Figure 7:
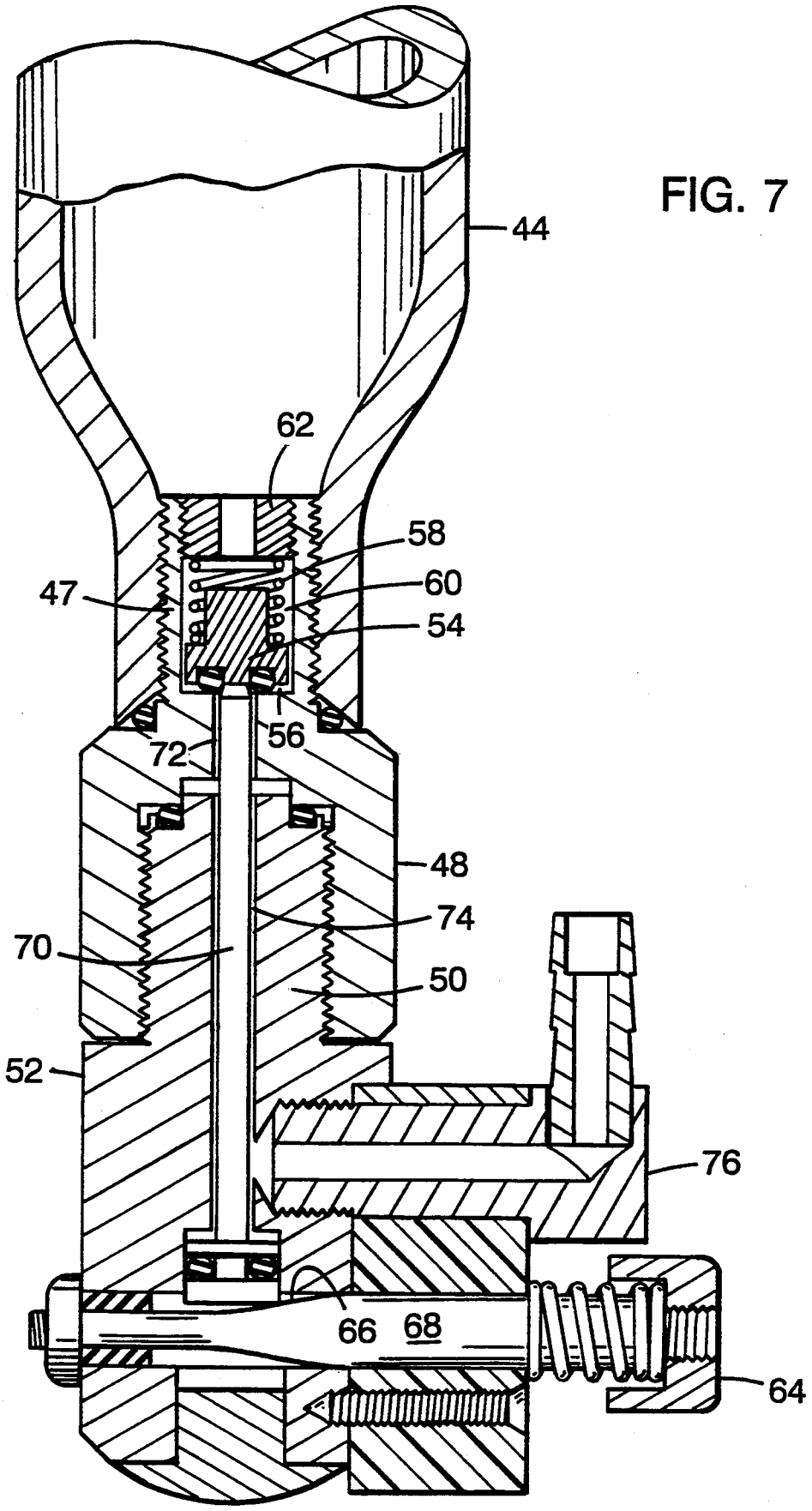
FIG. 7 is a partial elevational view, partially in section, of the source of gas and pneumatic system of FIG. 6 showing the valving and air passages of the pneumatic system.

Flotation collar 16 is inflated by a pressurized container of gas 44 and a pneumatic system 46 housed within support stalk 12, as shown in FIG. 6. As shown in FIG. 7, pressurized container 44 is screwed onto the post end 47 of valve adaptor 48, which in turn is screwed onto manifold stud 50 projecting from valve manifold 52. Valve 54, biased against valve seat 56 by spring 58, is retained within bore 60 in the post end 47 of valve adapter 48 by retaining ring 62. Spring 58 need not be very stiff, as the gas pressure within container 44 will be acting to seat valve 54; spring 58 is necessary to seat valve 54 when container 44 has been emptied of gas. O-rings are used to seal mating and seating surfaces.

Depressing inflation control button 64 causes taper portion 66 of button post 68 to force pin actuator 70 upward, lifting valve 54 from valve seat 56. Gas is released from container 44; flows through bore 60 and bores 72, 74 in which pin actuator 70 reciprocates; out through outlet plug 76—which is screwed into valve manifold 52—to inflation collar 16 via gas line 77.

Because the floating antenna system 10 is intended to be used by divers, it is convenient for the gas used to inflate flotation collar 16 to be compressed air "leeched" from a diver's scuba tank. Because scuba cylinders are typically filled to 3000 psi internal pressure, pressurized container 44 should preferably be constructed such that it can withstand such internal pressure itself. The internal volume may be varied as desired, depending on how many deployments of the floating antenna system are desired from a single fill of gas. Since displacement of a single cubic foot of water generates 64 pounds of positive buoyant force, a single cubic foot of gas (at atmospheric pressure) is generally adequate. This requires an internal volume of pressurized container 44 of 0.0049 cubic feet, assuming a fill pressure of 3000 psi.

Because pressurized container 44 is screwed to valve adapter 48 rather than directly to manifold stud 50, it may be removed for filling simply by unscrewing valve adapter 48 from manifold stud 50, irrespective of the gas pressure inside container 44. Valve adapter 48 would then be screwed onto a fill adapter (not shown), having a stud of the same shape as manifold stud 50, which is attached to a scuba tank. Gas released from the scuba tank would have sufficient pressure to lift valve 54 from valve seat 56 so as to fill pressurized container 44.

Ballast 78 (FIG. 6) is provided in sufficient quantity to ensure slight negative buoyancy when the system 10 is in the non-deployed, transport mode, i.e., inflation collar 16 is fully deflated. Positive buoyancy attributable to pressurized container 44 will be at its maximum when pressurized container 44 is emptied of gas. Therefore, ballast 78 should be provided in quantity sufficient to render the system 10 negatively buoyant when inflation collar 16 is deflated, support stalk 12 is flooded, and the supply of gas within pressurized container 44 has been used up.

Ballast 78 may be affixed to end cap 80 located at the lower end of support stalk 12, opposite from radome 14. This location enhances stability—and hence righting ability—of the floating antenna system by maximizing the distance between the centers of mass and buoyancy, at least when flotation collar 16 is inflated sufficiently to support radome 14 above the surface of the water.

Figure 8:
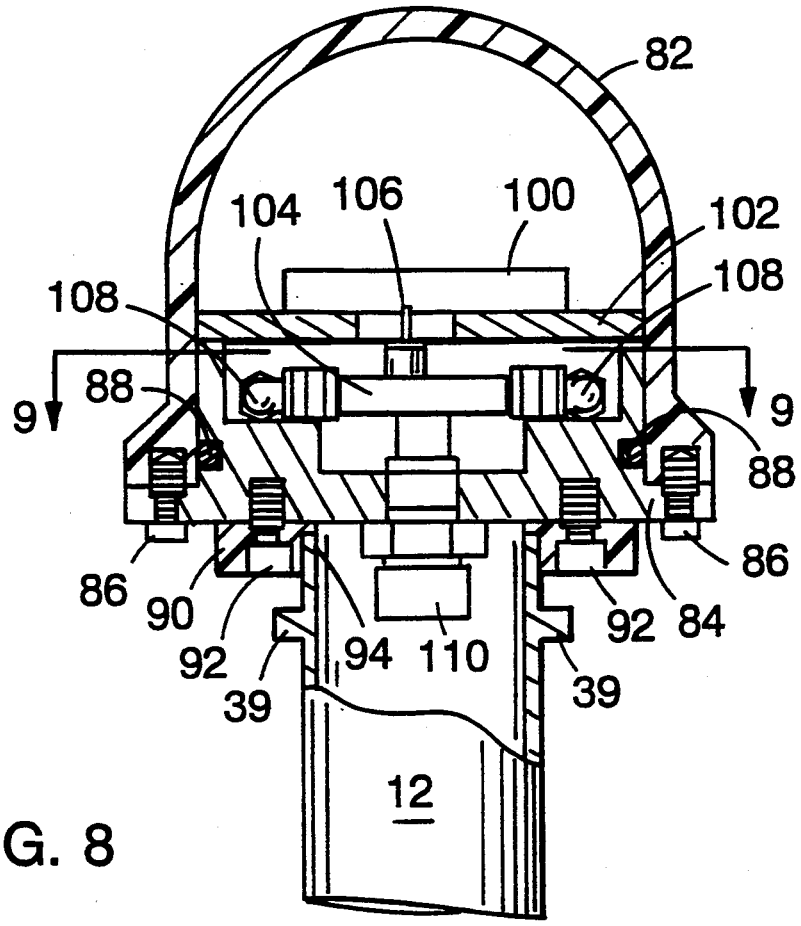
FIG. 8 is a partial elevational view, partially in section, of the upper portion of the support stalk and radome of the antenna system of FIG. 1 without the flotation collar, depicting the radome assembly, antenna element, and associated electronics.

As shown in FIG. 8, radome 14 consists of hemispherical radome canopy 82 and generally disc-shaped radome base 84 of approximately the same diameter. The open end of radome canopy 82 is secured to radome base 84 with fasteners 86. O-ring 88 is used to seal the radome 14. Radome 14 does not need to be pressurized; i.e., the pressure inside is atmospheric pressure where it is assembled. Radome canopy 82 and radome base 84, however, must be able to withstand water pressures to which floating antenna system 10 may foreseeably be subjected. Diver operating depths of 300 feet or more are commonly realized; radome canopy 82 and radome base 84 therefore need to be designed to withstand external pressure at depths of up to and including 300 feet of sea water. This may be accomplished by making the parts sufficiently thick; alternatively, interior bracing may be provided (not shown).

Mounting collar 90 is attached to the underside of radome base 84 with fasteners 92. Mounting collar 90 is fastened to upper end 94 of support stalk 12 with marine cement or similar salt water-impervious fastening agent.

The floating antenna system 10 as disclosed is used to obtain satellite signals from the Global Positioning System. The Global Positioning System (GPS) is a network of earth orbiting satellites which provide signals from which a GPS receiver may determine where it (the receiver) is on the surface of the earth. GPS satellites broadcast signals in a commercial frequency band, which has a mid-range of 1575 MHz, and a military frequency band, which has a mid-range of 1227 MHz.

Antenna element 100—designed to pick up these frequency ranges—is a dual-frequency, dual-polarization, microstrip antenna. It is affixed to mounting shelf 102 with epoxy, and should be positioned as equidistant from the walls of radome 14 as possible. Mounting shelf 102 should be made from aluminum so as to provide some nominal electrical ground reference.

Figure 9:
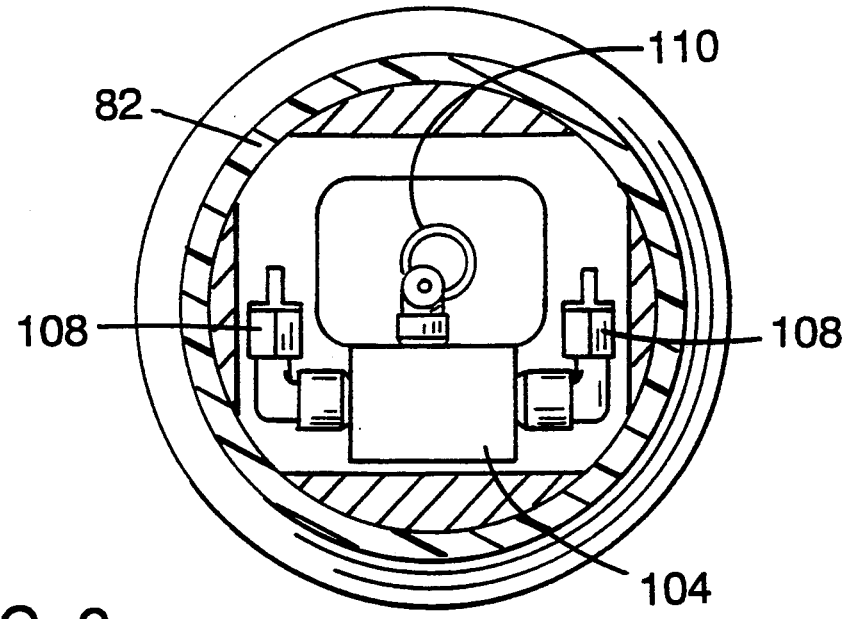
FIG. 9 is a plan view of the radome assembly of FIG. 8, taken along line 9—9 in FIG. 8, showing the preamplifier and associated electrical connectors.

It may also be preferable to include a high gain, low noise (less than 1.5 db NF) gallium arsenide preamplifier 104 inside radome 14 (FIGS. 8, 9). Located under mounting shelf 102, preamplifier 104 is connected to antenna element 100 by SMA right angle connector 106 and cable (not shown) passing through mounting shelf 102. As shown in FIG. 9, SMA right angle connectors 108 and cable (not shown) are used to connect the outputs of preamplifier 104 to waterproof, pressure-proof connector 110 passing through radome base 84. Preamplifier 104, connectors 106, 108, and all cable need to be matched to the frequency of interest at which signals are being received or broadcast.

In order for antenna element 100 to receive the GPS signals, radome 14 must be electromagnetically transparent to signals in the frequency band of interest. Radome 14 must also be resistant to salt water. It has been determined that glass reinforced, modified polyphenylene oxide resin provides the necessary electromagnetic transparency, is salt water resistant, and provides satisfactory structural strength. Radome canopy 82 is preferably constructed of Noryl® SE1GFN3, and radome base 84 is preferably constructed of Noryl® EN265. Mounting collar 90 is preferably constructed of ABS.

Figure 10:
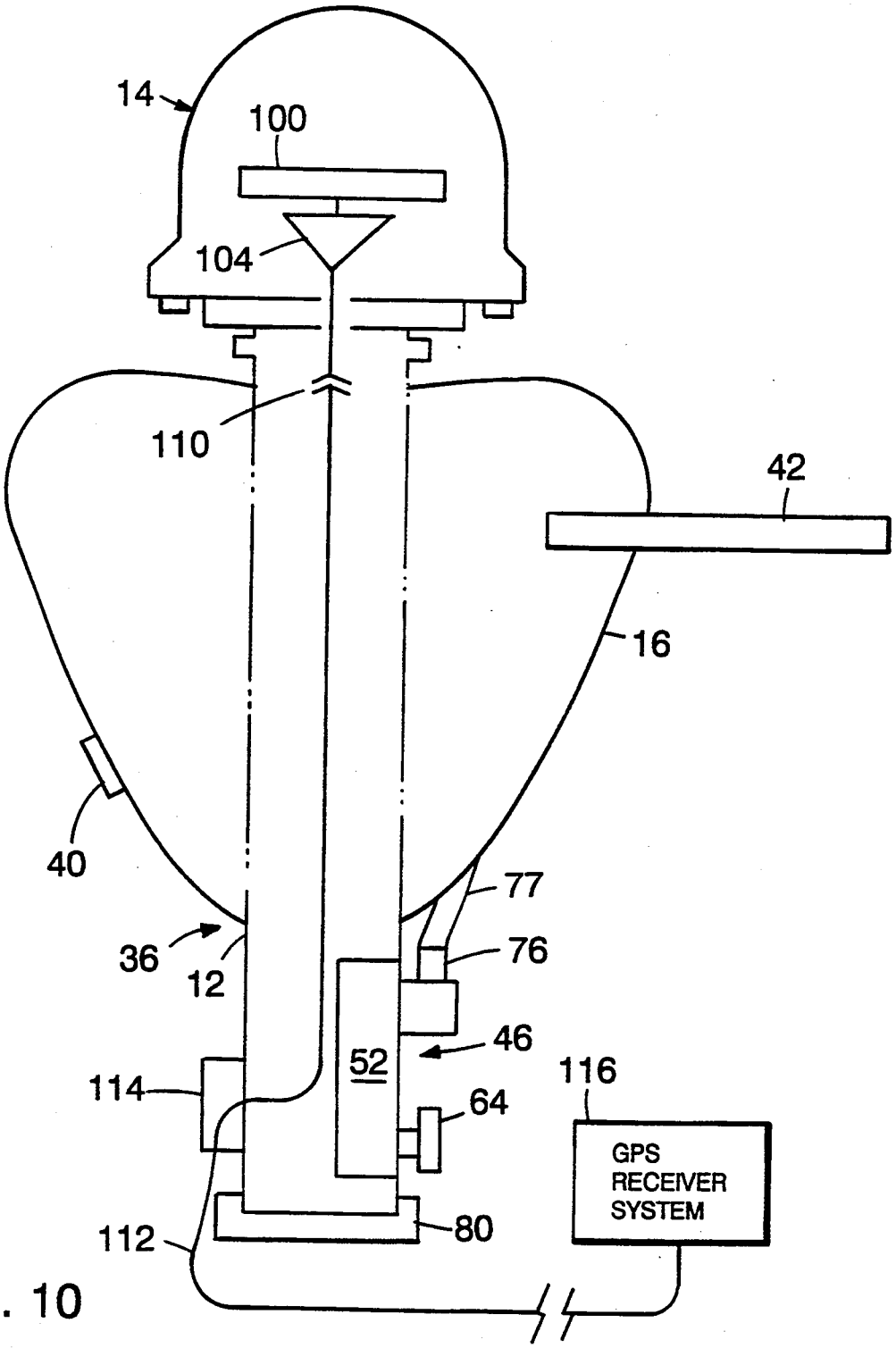
FIG. 10 is a schematic depicting the floating antenna system in communication with a submersible Global Positioning System receiver system.

As shown in FIG. 10, signal conducting tether cable 112 is connected to connector 110. Tether cable 112 is anchored to support stalk 12 by anchor block 114. This relieves stress on connector 110 and prevents tether cable 112 from becoming disconnected.

Providing a length of cable 112 allows a diver to deploy the floating antenna system 10 from a submerged position. The diver's end of tether cable 112 is connected to submersible GPS receiver system 116, a number of which are commercially available, which processes the GPS signals to determine the diver's location. All required electronics and power supply are located within GPS receiver system 116. In other embodiments, antenna element 100 may have broadcasting capabilities, and GPS receiver system 116 may instead be a signal generating device which generates signals to be broadcast from antenna element 100.

In operation, a diver at depth, say 30 feet, depresses inflation control button 64 to release a small amount of gas into flotation collar 16. It is only necessary to fill flotation collar 16 with enough gas to establish a positive buoyancy of about one half to one pound. Floating antenna system 10 is then released, with ascent to the surface controlled by the diver by holding on to tether cable 112. As the system 10 rises in the water column, decreasing external pressure allows flotation collar 16 to inflate further. By the time it reaches the surface, flotation collar 16 has expanded enough to develop two to three pounds of positive buoyancy, enough to support radome 14 above the surface of the water. At this point, the diver will feel tether cable 112 slacken and will know that the system has been deployed.

GPS signals are received, amplified, and conducted to the diver via signal conducting tether cable 112. The diver's global position is then displayed to the diver by GPS receiver system 116.

To retrieve the floating antenna system 10 from the surface, the diver merely pulls it down using signal conducting tether cable 112. As the floating antenna system 10 is pulled down, increasing external pressure deflates flotation collar 16, decreasing net positive buoyancy. When the antenna is fully retrieved, if further buoyancy reduction is required, the diver can squeeze flotation collar 16 to vent remaining gas through overpressure dump valve 40. The deflated flotation collar is then secured with hook and loop fastener strap 42.

It is evident that those skilled in the art may now make numerous uses and modifications of and departures from the specific embodiments described herein without departing from the inventive concepts.

What is claimed is:

1. A diver deployed, multiply-deployable/multiply-retrievable floating antenna system comprising a support stalk having upper and lower ends, an environmentally sealed, pressure proof radome disposed at said upper end, an antenna element disposed within said radome, a reusably inflatable flotation collar surrounding said support stalk at said upper end and disposed below said radome for supporting said radome above a water surface, a source of gas, a diver-operated pneumatic system which allows a selectively controlled amount of said gas to fill said flotation collar, evacuation means for evacuating said gas from said flotation collar, and a signal conducting tether cable in signal conducting relationship with said antenna element for deploying and retrieving the antenna system underwater under the control of the diver.

2. The floating antenna system of claim 1, wherein said pneumatic system comprises a valve manifold having a diver operable inflation control, and a gas line providing communication between said valve manifold and said flotation collar, said support stalk is a hollow cylinder, and said source of gas is a gas-filled pressurized container disposed within said support stalk and connected to said valve manifold so as to release gas in controlled amounts in response to a diver's operating said inflation control.

3. The floating antenna system of claim 2, wherein said support stalk has fill/drain holes which allow water to flood into and drain from said support stalk.

4. The floating antenna system of claim 3, further comprising ballast in a quantity sufficient to render the floating antenna system negatively buoyant when said support stalk is flooded with water, said flotation collar is deflated, and said pressurized container is evacuated of gas, wherein said flotation collar is inflatable to impart sufficient positive buoyancy to said floating antenna system to support said radome above said water surface, and said ballast is located so as to stabilize the floating antenna system in an upright position at least when the system has sufficient positive buoyancy to support the radome above said water surface.

5. The floating antenna system of claim 2, wherein said pressurized container has an operational fill pressure of 3000 pounds per square inch.

6. The floating antenna system of claim 1, wherein said radome comprises a substantially hemispherical radome canopy having an open end, and a generally disc-shaped radome base having an upper side, the open end of said radome canopy being sealed to the upper side of said radome base, and said radome is attached to said upper end of said support stalk.

7. The floating antenna system of claim 6, wherein said antenna element is a receiver responsive to signals generated by Global Positioning System satellites.

8. The floating antenna system of claim 7, wherein said antenna element is a dual-frequency, dual-polarization, microstrip antenna.

9. The floating antenna system of claim 7, wherein said radome canopy and said radome base are constructed of any material which is electromagnetically transparent to signals in a frequency band of interest and which is resistant to salt water.

10. The floating antenna system of claim 9, wherein said radome canopy and said radome base are constructed of glass reinforced modified polyphenylene oxide resin.

11. The floating antenna system of claim 1, wherein said radome remains sealed and structurally intact at water depths of up to and including 300 feet of sea water.

12. The floating antenna system of claim 1, wherein said evacuation means is an overpressure dump valve which vents gas from inside said flotation collar when gas pressure within said flotation collar exceeds gas or water pressure exterior to said flotation collar by 2 psi or more.

13. The floating antenna system of claim 1, wherein said signal conducting tether cable is capable of transmitting radio frequency signals.

14. The floating antenna system of claim 13, said signal conducting tether cable having a distal end opposite from said antenna element, further comprising a signal processing unit attached to said distal end for transmitting or receiving signals.

15. The floating antenna system of claim 14, wherein said signal processing unit is a global positioning system signal processor for determining where on the surface of the Earth the floating antenna system is located.

16. The floating antenna system of claim 1, wherein said evacuation means is an overpressure dump valve which allows the diver to reduce the buoyancy of the antenna system if necessary upon underwater retrieval by squeezing the floatation collar.

17. A diver deployed, multiply-deployable/multiply-retrievable floating antenna system comprising a support stalk having upper and lower ends, an environmentally sealed, pressure proof radome disposed at said upper ends, an antenna element disposed within said radome, an inflatable flotation collar surrounding said support stalk at said upper end and disposed below said radome for supporting said radome above a water surface, said flotation collar being generally in the shape of a pyramidoid, said pyramidoid having a generally squarish base which has a center and generally triangular sides meeting at a vertex, said support stalk passing through the center of said base and through said vertex, said flotation collar being oriented and positioned with the vertex pointing towards the lower end of the support stalk and the base located just below the radome, a source of gas, a pneumatic system which allows a selectively controlled amount of said gas to fill said flotation collar, evacuation means for evacuating said gas from said flotation collar, and a signal conducting tether cable in environmentally sealed signal conducting relationship with said antenna element.

18. The floating antenna system of claim 17, wherein said flotation collar is constructed of flexible panels of waterproof, airtight fabric such that when said flotation collar is evacuated of gas, said flotation collar is collapsible so as to allow it to be wrapped around said support stalk.

19. A diver deployed, multiply-deployable/multiply-retrievable floating antenna system comprising a support stalk having upper and lower ends, an environmentally sealed, pressure proof radome disposed at said upper end, an antenna element disposed within said radome, an inflatable flotation collar surrounding said support stalk at said upper end and disposed below said radome for supporting said radome above a water surface, said flotation collar being collapsible so as to be transversely wrapped around said support stalk in closed umbrella-like fashion, a source of gas, a pneumatic system which allows a selectively controlled amount of said gas to fill said flotation collar, evacuation means for evacuating said gas from said flotation collar, and a signal conducting tether cable in signal conducting relationship with said antenna element.

20. A diver deployed, multiply-deployable/multiply-retrievable floating antenna system comprising a support stalk having upper and lower ends, an environmentally sealed, pressure proof radome disposed at said upper end, an antenna element disposed within said radome, an inflatable flotation collar surrounding said support stalk at said Upper end and disposed below said radome for supporting said radome above a water surface, said flotation collar being comprised of an assembly of edgewise connected, diamond-shaped panels of fabric, a source of gas, a pneumatic system which allows a selectively controlled amount of said gas to fill said flotation collar, evacuation means for evacuating said gas from said flotation collar, and a signal conducting tether cable in signal conducting relationship with said antenna element.

* * * * *